US006030937A

United States Patent [19]

Kruse et al.

[11] Patent Number: 6,030,937

[45] **Date of Patent: *Feb. 29, 2000**

[54] METHOD OF PREPARING SACCHAROSE SURFACTANT GRANULATES

[75] Inventors: Hans-Friedrich Kruse, Korschenbroich; Volker Bauer, Duesseldorf; Georg Assmann, Juechen, all of Germany

[73] Assignee: Henkel Kommanditgesellschaft auf Aktien, Duesseldorf, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/983,416

[22] PCT Filed: Jul. 1, 1996

[86] PCT No.: PCT/EP96/02862

§ 371 Date: Mar. 12, 1998

§ 102(e) Date: Mar. 12, 1998

[87] PCT Pub. No.: WO97/03165

PCT Pub. Date: Jan. 30, 1997

[30] Foreign Application Priority Data

Jul. 10, 1995 [DE] Germany ..... 195 24 464

[51] Int. Cl.[7] ..... C11D 1/66; C11D 1/825; C11D 1/83

[52] U.S. Cl. ..... 510/443; 510/470; 510/501

[58] Field of Search ..... 510/443, 470, 510/501

[56] References Cited

U.S. PATENT DOCUMENTS

| | | | |
|---|---|---|---|
| 1,985,424 | 12/1934 | Piggott | 260/124 |
| 2,016,962 | 10/1935 | Flint et al. | 260/127 |
| 2,703,798 | 3/1955 | Schwartz | 260/211 |
| 5,374,716 | 12/1994 | Biermann et al. | 536/18.6 |
| 5,397,507 | 3/1995 | Bauer et al. | 252/549 |
| 5,536,431 | 7/1996 | Carduck et al. | 510/444 |
| 5,576,425 | 11/1996 | Hill et al. | 536/18.6 |
| 5,597,794 | 1/1997 | Bauer et al. | 510/457 |

FOREIGN PATENT DOCUMENTS

| | | |
|---|---|---|
| 0 301 298 | 2/1989 | European Pat. Off. . |
| 0 550 086 | 7/1993 | European Pat. Off. . |
| 0 618 290 | 10/1994 | European Pat. Off. . |
| 40 21 476 | 1/1992 | Germany . |
| 41 02 745 | 8/1992 | Germany . |
| 41 39 551 | 6/1993 | Germany . |
| 42 16 775 | 11/1993 | Germany . |
| WO87/02053 | 4/1987 | WIPO . |
| WO90/03977 | 4/1990 | WIPO . |
| WO92/02609 | 2/1992 | WIPO . |
| WO92/06151 | 4/1992 | WIPO . |
| WO92/06984 | 4/1992 | WIPO . |
| WO93/07246 | 4/1993 | WIPO . |
| WO95/14519 | 6/1995 | WIPO . |

OTHER PUBLICATIONS

Tens. Surf. Det. 25:8 (1988).
Römpp, Chemie Lexikon, 9th Ed., Thieme Verlag, vol. 6, p 5003.
Z. Chem. 28:41 (1988).
Glastechn. Ber. 37:194 (1964).
Amer. Mineral 38:163 (1953).

*Primary Examiner*—Mark Kopec
*Assistant Examiner*—John R. Hardee
*Attorney, Agent, or Firm*—John E. Drach; Daniel S. Ortiz

[57] ABSTRACT

A process for the production of surfactant granules by contacting an alkyl or alkenyl oligosaccharide paste with a zeolite or a water glass under conditions in which the mixture is simultaneously granulated and dried.

20 Claims, No Drawings

METHOD OF PREPARING SACCHAROSE SURFACTANT GRANULATES

FIELD OF THE INVENTION

This invention relates to a process for the production of sugar surfactant granules in which aqueous sugar surfactant pastes are subjected to granulation in the presence of selected silicon compounds.

PRIOR ART

Sugar surfactants, for example, alkyloligoglucosides and fatty acid N-alkyl glucamides, are distinguished by excellent detergent properties and high ecotoxicological compatibility. For this reason, these classes of nonionic surfactants are acquiring increasing significance. Although they have heretofore generally been used in liquid formulations, for example, dishwashing detergents and hair shampoos, there is now also a market need for solid water-free formulations which may even be incorporated, for example, in powder-form detergents.

In general, liquid surfactant formulations are industrially dried by conventional spray drying in which the aqueous surfactant paste is sprayed at the head of a tower in the form of fine droplets against which hot drying gases are passed in countercurrent. Unfortunately, this technology cannot readily be applied to sugar surfactant pastes because the temperatures required for drying are above the caramelization temperature, i.e., the decomposition temperature, of the sugar surfactants. In short, carbonized products are obtained in the conventional drying of sugar surfactant pastes, in addition to which caking occurs on the walls of the spray-drying tower and necessitates expensive cleaning at short intervals.

Attempts have been made in the past to overcome this problem. For example, German patent application DE-A1 41 02 745 (Henkel) describes a process in which a small quantity (1 to 5 weight %) of alkylglucoside is added to a fatty alcohol paste which is then subjected to conventional spray drying. Unfortunately, this process can only be carried out in the presence of a large quantity of inorganic salt. According to German patent application DE-A1 41 39 551 (Henkel), a paste of alkyl sulfate and alkylglucoside, which may only contain at most 50 weight % of the sugar surfactant, is sprayed in the presence of a mixture of soda and zeolite. However, this only gives compounds which have a low surfactant concentration and an inadequate apparent density. International patent application WO 95/14519 (Henkel) describes a process in which sugar surfactant pastes are subjected to drying with superheated steam. Unfortunately, this process is industrially very expensive. German patent application DE-A1 42 09 339 (Henkel) relates to a process for dewatering aqueous formulations of alkylglucoside and inorganic salt, for example, zeolite or water glass, in a horizontal turbine dryer with rotating baffles. The resulting solids have a high surfactant content, but the apparent density is comparatively low and the dissolution rate is unsatisfactory. German patent application DE-A1 40 21 476 describes the granulation of aqueous alkylglucoside pastes in a mixer with the addition of soda. However, the resulting water-containing granules have a surfactant content less than 50 weight % and must be dried in a second step in a fluidized bed.

Accordingly, the complex problem addressed by the present invention was to provide a simple process for the production of sugar surfactant granules that would be distinguished by their high surfactant content, a high apparent density, ready solubility even in cold water and good color quality and which, at the same time, would be dust-dry, free-flowing and stable in storage.

DESCRIPTION OF THE INVENTION

The present invention relates to a process for the production of sugar surfactant granules having a sugar surfactant content of 30 to 90 weight %, preferably 50 to 85 weight %, and particularly 70 to 80 weight %, in which an aqueous paste of (a) alkyl- and/or alkenyloligoglycoside and/or (b) fatty acid N-alkyl polyhydroxyalkylamide is subjected to granulation in the presence of zeolite and/or water glass, optionally with simultaneous or subsequent drying.

It has surprisingly been found that use of the specified silicon compounds as a support substance provides granules with an unexpectedly high apparent density in the range from 500 to 1000 g/l and a sugar surfactant content from 30 to 90 weight %. The granules are externally dust-dry even at residual water contents of up to 20 weight %, which eliminates the need for subsequent drying. They are free-flowing and stable in storage, do not show any tendency to form lumps, and dissolve easily and substantially completely even in cold water. In addition, they show excellent color quality. The invention includes the discovery that the simultaneous spraying of active substance and a support substance solution results in the active substance becoming largely enclosed by the support substance, which leads to especially advantageous storage properties and a negligible tendency for water absorption to occur during storage.

The Alkyl- and/or Alkenyloligoglycosides

The alkyl- and alkenyloligoglycosides are known nonionic surfactants which correspond to formula (I):

$$R^1O—(G)_p \quad (I)$$

in which $R^1$ is an alkyl and/or alkenyl radical containing 4 to 22 carbon atoms, G is a sugar unit containing 5 or 6 carbon atoms and p is a number from 1 to 10. They may be obtained by the relevant methods of preparative organic chemistry. EP-A1-0 301 298 and WO 90/03977 are cited as representative of the extensive literature available on this subject.

The alkyl- and/or alkenyloligoglycosides may be derived from aldoses or ketoses containing 5 or 6 carbon atoms, preferably glucose. Accordingly, the preferred alkyl- and/or alkenyloligoglycosides are alkyl- and/or alkenyloligoglucosides. The index p in general formula (I) indicates the degree of oligomerization (DP), i.e., the distribution of mono- and oligoglycosides, and is a number from 1 to 10. While p in a given compound must always be an integer and most prominently may assume a value from 1 to 6, the value p for a particular alkyloligoglycoside is an analytically determined calculated quantity which is generally a decimal fraction. Alkyl- and/or alkenyloligoglycosides having an average degree of oligomerization p of 1.1 to 3.0 are preferably used. Alkyl- and/or alkenyloligoglycosides having a degree of oligomerization of less than 1.7 and more particularly having a degree of oligomerization between 1.2 and 1.4 are preferred from an applications standpoint.

The alkyl or alkenyl radical $R^1$ may be derived from primary alcohols containing 4 to 11 and preferably 8 to 10 carbon atoms. Typical examples are butanol, caproic alcohol, caprylic alcohol, capric alcohol and undecyl alcohol and the technical mixtures thereof as obtained, for example, by the hydrogenation of technical fatty acid methyl esters or the hydrogenation of aldehydes from Roelen's oxosynthesis. The alkyloligoglucosides (DP=1 to 3) of $C_8$ to $C_{10}$ chain lengths, which are obtained as first runs in the distillative separation of technical $C_8$ to $C_{18}$ coconut oil fatty alcohol and which may contain less than 6 weight % $C_{12}$ alcohol as an impurity, and also alkyloligoglucosides (DP=1 to 3) based on technical $C_{9/11}$ oxoalcohols are preferred. In addition, the alkyl or alkenyl radical $R^1$ may also be derived from primary alcohols containing 12 to 22 and preferably 12 to 14 carbon atoms. Typical examples are lauryl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol, brassidyl alcohol, and technical mixtures thereof which may be obtained as described above. Alkyloligoglucosides based on hydrogenated $C_{12/14}$ coconut oil fatty alcohol and having a DP of 1 to 3 are preferred.

The Fatty Acid N-alkyl Polyhydroxyalkylamides

Fatty acid N-alkyl polyhydroxyalkylamides are nonionic surfactants which correspond to formula (II):

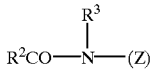

(II)

in which $R^2CO$ is an aliphatic acyl radical containing 6 to 22 carbon atoms, $R^3$ is hydrogen or an alkyl or hydroxyalkyl radical containing 1 to 4 carbon atoms and (Z) is a linear or branched polyhydroxyalkyl radical containing 3 to 12 carbon atoms and 3 to 10 hydroxyl groups.

Fatty acid N-alkyl polyhydroxyalkylamides are known compounds which may generally be obtained by reductive amination of a reducing sugar with ammonia, an alkylamine or an alkanolamine and subsequent acylation with a fatty acid, a fatty acid alkyl ester or a fatty acid chloride. Processes for their production are described in U.S. Pat. No. 1,985,424, in U.S. Pat. No. 2,016,962 and in U.S. Pat. No. 2,703,798 and in International patent application WO 92/06984. An overview of this subject by H. Kelkenberg can be found in Tens. Surf. Det. 25, 8 (1988). The fatty acid N-alkyl polyhydroxyalkylamides are preferably derived from reducing sugars containing 5 or 6 carbon atoms and more particularly from glucose. Accordingly, the preferred fatty acid N-alkyl polyhydroxyalkylamides are fatty acid N-alkyl glucamides which correspond to formula (III):

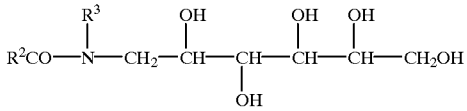

(III)

Preferred fatty acid N-alkyl polyhydroxyalkylamides are glucamides with formula (III) in which $R^3$ is hydrogen or an alkyl group and $R^2CO$ represents the acyl component of caproic acid, caprylic acid, capric acid, lauric acid, myristic acid, palmitic acid, palmitoleic acid, stearic acid, isostearic acid, oleic acid, elaidic acid, petroselinic acid, linoleic acid, linolenic acid, arachic acid, gadoleic acid, behenic acid or erucic acid or technical mixtures thereof. Fatty acid N-alkyl glucamides (III) obtained by reductive amination of glucose with methylamine and subsequent acylation with lauric acid or $C_{12/14}$ coconut oil fatty acid or a corresponding derivative are particularly preferred. In addition, the polyhydroxyalkylamides may also be derived from maltose and palatinose.

The Zeolites

In the context of the process according to the invention, zeolites are optionally water-containing alkali metal or alkaline earth metal aluminosilicates corresponding to general formula (IV):

$$M^1_{2/z}O \cdot Al_2O_3 \cdot xSiO_2 \cdot yH_2O \quad (IV)$$

in which $M^1$ is an alkali metal or alkaline earth metal with a valence of z, x is a number from 1.8 to 12 and y is a number from 0 to 8. The zeolites may be of natural or synthetic origin.

Typical examples are the naturally occurring minerals clinoptilolite, erionite and chabasite. However, preferred zeolites are synthetic zeolites, for example zeolite X ($Na_{86}((AlO_2)_{86}(SiO_2)_{106}) \cdot 264\ H_2O$)

zeolite Y ($Na_{56}((AlO_2)_{56}(SiO_2)_{136}) \cdot 325\ H_2O$)

zeolite L ($K_9((AlO_2)_9(SiO_2)_{27}) \cdot 22\ H_2O$)

mordenite ($Na_{8.7}((AlO_2)_{8.7}(SiO_2)_{39.3}) \cdot 24\ H_2O$)

and more particularly zeolite P or A ($Na_{12}((AlO_2)_{12}(SiO_2)_{12}) \cdot 27\ H_2O$)

The water Glass

The expression "water glass" is intended to encompass amorphous alkali metal silicates corresponding to formula (V) and/or crystalline alkali metal silicates corresponding to formula (VI):

$$(SiO_2)_m(M^2{}_2O)_{n1} \quad (V)$$

$$(SiO_2)_m(M^2{}_2O)_{n2}(H_2O)_{x2} \quad (VI)$$

in which $M^2$ is lithium, sodium or potassium; m and n1 are whole numbers or decimal fractions >0; n2=1; and x2=0 or an integer from 1 to 20.

The amorphous alkali metal silicates are glass-like, water-soluble salts of silicic acid solidified from the melt. Their production is described, for example, in RÖMPP Chemie Lexikon, 9th Edition, Thieme Verlag, Stuttgart, Vol. 6, page 5003. Both alkali metal silicates with a low $SiO_2$:$M_2O$ or m:n ratio ("basic" water glasses) and alkali metal silicates with a high m:n ratio ("neutral" or "acidic" water glasses) may be used for the process according to the invention. The $SiO_2$:$M_2O$ ratio is also known as the "modulus" of the silicate. In addition, an overview can be found in Z. Chem. 28, 41 (1988).

The crystalline alkali metal silicates are also known substances. They have a layer-like structure and may be obtained, for example, by sintering alkali metal water glass or by hydrothermal reactions (Glastechn. Ber., 37 194 (1964)). Suitable crystalline alkali metal silicates are, for example, makatite ($Na_2Si_4O_9 \cdot 5\ H_2O$), kenyaite ($Na_2Si_{22}O_{45} \cdot 10\ H_2O$) or ilerite ($Na_2Si_8O_{17} \cdot 9\ H_2O$)

(Amer. Mineral. 38, 163 (1953)). Water glasses in which M is sodium and x=0 and for which the modulus, i.e., the m:n ratio, is from 1.9 to 4 and preferably from 1.9 to 2.5, have proven to be particularly suitable as supports for the granulation process. The water glasses may be used in the form of solids or as aqueous solutions with a solids content of 1 to 80 weight % and preferably 30 to 60 weight %, based on the silicate compound.

Granulation in a Mixer

In a particularly simple embodiment of the process according to the invention, the water-free silicon compound, i.e., the zeolite or the water glass, is preliminarily introduced and thoroughly mixed with the corresponding quantity of aqueous sugar surfactant paste—which may have a solids content of 30 to 65 weight %.

Mixers such as, for example, Lodige blade mixers and particularly Schugi spray mixers, in which the aqueous paste is mechanically sheared by the mixing tools and dried, may advantageously be used for this process step. Drying and mixing may also be carried out simultaneously in a fluidized bed dryer.

Granulation in a Fluidized Bed

Fluidized bed or SKET granulation is understood to be granulation with simultaneous drying, preferably carried out batchwise or continuously in a fluidized bed. To this end, the sugar surfactant, preferably in the form of the aqueous paste or solution, and the support substance, preferably in the form of the aqueous solution, may be introduced simultaneously or successively or as a solution mixture through one or more nozzles ("nozzle spraying"). This nozzle spraying takes place on seed crystals which preferably have the final composition of the compound and which generally result from the fine-granule or extremely fine-granule fractions of earlier batches or which are constantly formed anew in a continuous production process. A supplementary addition of the extremely fine-granule fraction may be necessary. Preferred fluidized bed installations have base plates measuring 0.4 to 5 m in diameter. SKET granulation is preferably carried out at fluidizing air flow rates of 1 to 8 m/s. The granules are preferably discharged from the fluidized bed via a sizing stage. Sizing may be effected, for example, by means of a sieve or by an airstream flowing in countercurrent (sizing air) that is controlled in such a way that only particles beyond a certain size are removed from the fluidized bed while smaller particles are retained in the fluidized bed. The inflowing air is normally made up of the heated or unheated sizing air and the heated bottom air. The temperature of the bottom air is between 50 and 400° C. and preferably between 90 and 350° C. A starting material, preferably zeolite or overdried water glass or SKET granules from an earlier test batch, is advantageously introduced at the beginning of the SKET granulation process. The water from the sugar surfactant paste and the support substance solution evaporates in the fluidized bed, resulting in the formation of partly dried to fully dried nuclei, which become coated with additional quantities of surfactant and support substance and are granulated and simultaneously re-dried. The result is a sugar surfactant granule with a surfactant gradient over the granule which shows particularly high solubility in water. Since the granule is coated with simultaneously dried support substance, it has particularly good storage properties and, at the same time, is less hygroscopic than product generated by the application of pure surfactant solution to a solid support.

Preferred Embodiments of the Granulation Process

The process according to the invention may be carried out in two embodiments—which are applicable to both mixers and fluidized beds. On the one hand, the silicon compound (i.e., zeolite or water glass) may be preliminarily introduced as a crystallization nucleus and a highly concentrated sugar surfactant paste, for example, a 30 to 65 weight % paste, may subsequently be sprayed on. Alternatively, the sugar surfactant paste may be mixed with the silicon compound to form a type of "slurry" and this combination may then be sprayed and granulated. In the second variant, therefore, the use of liquid slurries or solutions of the silicon compound is particularly suitable.

The granulation process, particularly fluidized bed granulation, generally provides dry granules. This is also the case in particular because both zeolites and water glasses have a considerable storage capacity for water and, introduced through solutions into the fluidized bed, enclose the surfactant particles in the granules. This means that even granules with a residual moisture content of up to 20 weight % are completely dry on the outside because the water inside the granules is physically bound. An additional drying of the product is preferred in fluidized bed production, in which case the process must be carried out at suitably high temperatures.

Surfactants

Although the invention is concerned with the production of sugar surfactant granules, other anionic and/or nonionic surfactants may be used in combination with the sugar surfactants. After drying, the surfactants will be present either totally or partially enclosed in the support matrix, thus facilitating the production of highly concentrated detergent compounds with good storage properties.

Typical examples of anionic surfactants are alkylbenzenesulfonates, alkanesulfonates, olefinsulfonates, alkyl ether sulfonates, glycerol ether sulfonates, a-methyl ester sulfonates, sulfofatty acids, alkyl sulfates, fatty alcohol ether sulfates, glycerol ether sulfates, hydroxy mixed ether sulfates, monoglyceride (ether) sulfates, fatty acid amide (ether) sulfates, mono- and dialkyl sulfosuccinates, mono- and dialkyl sulfosuccinamates, sulfotriglycerides, amide soaps, ether carboxylic acids and salts thereof, fatty acid isethionates, fatty acid sarcosinates, fatty acid taurates, acyl lactylates, acyl tartrates, acyl glutamates, acyl aspartates, alkyloligoglucoside sulfates, protein-fatty acid condensates (more particularly wheat-based vegetable products), and alkyl (ether) phosphates and also fatty acid salts, i.e., soaps. Where the anionic surfactants contain polyglycol ether chains, the polyglycol ether chains may have a conventional homolog distribution, although they preferably have a narrow homolog distribution.

Typical examples of nonionic surfactants are fatty alcohol polyglycol ethers, alkylphenol polyglycol ethers, fatty acid polyglycol esters, fatty acid amide polyglycol ethers, fatty amine polyglycol ethers, alkoxylated triglycerides, mixed ethers and mixed formals, protein hydrolyzates (more particularly wheat-based vegetable products), polyol fatty acid esters, sugar esters, sorbitan esters, polysorbates and amine oxides. Where the nonionic surfactants contain polyglycol ether chains, the polyglycol ether chains may have a conventional homolog distribution, although they preferably have a narrow homolog distribution.

The mixing ratio between the sugar surfactants and the other surfactants is largely uncritical and may vary from 10:90 to 90:10. Mixtures of sugar surfactants with fatty alcohol sulfates, fatty acid isethionates, soaps, ether carboxylic acids, monoglyceride sulfates and fatty alcohol polyglycol ethers in a weight ratio of 70:30 to 30:70 and, more particularly, 60:40 to 40:60, are preferred.

Commercial Applications

The sugar surfactant granules afforded by the process according to the invention are free-flowing, do not form lumps and dissolve readily in cold water. Accordingly, they are suitable, for example, for the production of powder-form detergents, the granules preferably being added to the tower powders.

EXAMPLES

Example 1

Production of Readily Soluble APG SKET Granules

A 75:25 weight ratio mixture of an aqueous 50 weight % paste of cocoalkyloligoglucoside (Plantaren® APG 600, Henkel KGaA, Düsseldorf, FRG) and an aqueous 48 weight % water glass solution with a modulus of 2.4 was granulated and at the same time dried via a nozzle in a Glatt AGT granulator/dryer (Glatt, FRG). Dust-free, non-tacky granules with a residual water content of 5 weight % and a very uniform particle size distribution were obtained. The characteristic process data and the product distribution are reported in Table 1.

TABLE 1

SKET granulation of APG/water glass mixtures

| Group | Parameter | Measured value |
|---|---|---|
| Fluidized bed | Diameter (mm) | 400 |
| | Surface area ($m^2$) | 0.13 |
| | Air throughput ($m^3$/h) | 900 |
| | Air load (g $H_2O$/kg air) | 11 |
| | Air flow rate (m/s) | 2 |
| Temperature | Bottom air (° C.) | 93 |
| | Sizing air (° C.) | 20 |
| | Air exit (° C.) | 76 |
| Throughput | Alkyloligoglucoside (kg/h) | 22.5 |
| | Water glass (kg/h) | 7.5 |
| | Starting material (granules) (kg) | 20 |
| Characteristic product data | apparent density (g/l) | 550 |
| Particle size distribution | >1.6 mm (%) | 0.1 |
| | >0.8 mm (%) | 24 |
| | >0.4 mm (%) | 75.3 |
| | >0.2 mm (%) | 0.6 |
| | <0.2 mm (%) | — |

Example 2

Production of Readily Soluble Glucamide SKET Granules

An 80:20 weight ratio mixture of an aqueous 35 weight % paste of cocofatty acid N-methyl glucamide and a 48 weight % water glass solution with a modulus of 2.6 was granulated and simultaneously dried as in Example 1. Dust-free non-tacky granules with a residual water content of 7 weight % and a very uniform particle size distribution were obtained. The characteristic process data and the product distribution are reported in Table 2.

TABLE 2

SKET granulation of glucamide/water glass mixtures

| Group | Parameter | Measured value |
|---|---|---|
| Fluidized bed | Diameter (mm) | 400 |
| | Surface area ($m^2$) | 0.13 |
| | Air throughput ($m^2$/h) | 1000 |
| | Air load (g $H_2O$/kg air) | 10 |
| | Air flow rate (m/s) | 2 |
| Temperature | Bottom air (° C.) | 97 |
| | Sizing air (° C.) | 20 |
| | Air exit (° C.) | 75 |
| Throughput | Glucamide (kg/h) | 22 |
| | Water glass (kg/h) | 7.5 |
| | Starting material (granules) (kg) | 25 |
| Characteristic product data | apparent density (g/l) | 600 |
| Particle size distribution | >1.6 mm (%) | 0.2 |
| | >0.8 mm (%) | 9.1 |
| | >0.4 mm (%) | 80.2 |
| | >0.2 mm (%) | 10.3 |
| | <0.2 mm (%) | 0.2 |

Example 3

Production of Readily Soluble APG/TAS SKET Granules

A mixture of an aqueous 30% paste of cocoalkyloligoglucoside (Plantaren® APG 2000, Henkel KGaA, D üsseldorf, FRG), an aqueous 55 weight % paste of tallow alcohol sulfate sodium salt (Sulfopon® T50) and an aqueous 48 weight % water glass solution (modulus of 2.4) having a 70:30 weight ratio of surfactants APG:TAS=30:70) to water glass was granulated and simultaneously dried as in Example 1. Dust-free non-tacky granules with a residual water content of 7 weight % and a very uniform particle size distribution were obtained. The chracteristic process data and the product distribution are reported in Table 3.

TABLE 3

SKET granulation of APG/TAS/water glass mixtures

| Group | Parameter | Measured value |
|---|---|---|
| Fluidized bed | Diameter (mm) | 400 |
| | Surface area ($m^2$) | 0.13 |
| | Air throughput ($m^2$/h) | 1000 |
| | Air load (g $H_2O$/kg air) | 13 |
| | Air flow rate (m/s) | 2.2 |
| Temperature | Bottom air (° C.) | 100 |
| | Sizing air (° C.) | 20 |
| | Air exit (° C.) | 75 |
| Throughput | APG/TAS (kg/h) | 45 |
| | Water glass (kg/h) | 5 |
| | Starting material (granules) (kg) | 25 |
| Characteristic product data | apparent density (g/l) | 750 |
| Particle size distribution | >1.6 mm (%) | 0.2 |
| | >0.8 mm (%) | 11.5 |
| | >0.4 mm (%) | 75.8 |
| | >0.2 mm (%) | 12.3 |
| | <0.2 mm (%) | 0.2 |

Example 4

Production of APG/Zeolite P Granules in a Lödige Mixer

In a Lödige spray mixer, 3.5 kg of cocoalkyloligoglucoside (Plantaren® APG 1200 CSUP, Henkel KGaA, Düsseldorf, FRG) in the form of an aqueous 50 weight % paste was sprayed onto 6.5 kg zeolite P (Wessalith® Na-P, Degussa AG, Hanau, FRG). Dry, free-flowing granules with a particle size distribution suitable for powder detergents (100% <1.6 mm, main fraction between 0.8 and 0.4 mm) were obtained. Despite the unavoidable introduction of 17 weight % water, the product was dust-dry on the outside and did not show any tendency to form lumps, even in storage. It had an extremely high apparent density of 920 g/l. Even after drying off in a fluidized bed, the apparent density was still 830 g/l. The sugar surfactant content of the granules could be further increased by using the granules as starting material and spraying on more alkyloligoglucoside paste.

Example 5

Production of APG/Nonionic Surfactant/Zeolite P Granules in a

Lödige Mixer

The procedure was as in Example 4, except that the aqueous alkyloligoglucoside paste was replaced by a water-free mixture of the alkyloligoglucoside and a technical cocoalcohol+7EO adduct (50:50 weight ratio). Dust-dry granules with an apparent density of 750 g/l were obtained.

Example 6

Production of Glucamide/Water Glass Granules in a Lödige Mixer

Example 4 was repeated using a cocofatty acid N-methyl glucamide and an overdried layer silicate with a modulus of 2.4. Dry free-flowing granules with a particle size distribution suitable for powder detergents (100% <1.6 mm, main fraction between 0.8 and 0.4 mm) were obtained. Despite the unavoidable introduction of 15 weight % water, the product was dust-dry on the outside and did not show any tendency to form lumps, even in storage. It had an apparent density of 900 g/l.

Comparative Examples V1 and V2

Example 1 was repeated using soda and sodium chloride as supports instead of water glass. The resulting products were tacky and non-free-flowing with a distinctly lower apparent density and did not completely dissolve in cold water.

What is claimed is:

1. A process for the production of sugar surfactant granules with a sugar surfactant content in a range from 70 to 85 weight %, which comprises: simultaneously drying and granulating, in a fluidized bed, with air as the fluidizing medium, an aqueous paste comprising at least one sugar surfactant selected from the group consisting of alkyloligoglycoside, alkenyloligoglycoside and fatty acid N-alkyl polyhydroxyalkylamide in contact with at least one inorganic member selected from the group consisting of zeolite and waterglass and optionally a surfactant selected from the group consisting of anionic surfactants, nonionic surfactants and mixtures thereof wherein the nonionic suractant is not the at least one sugar surfactant.

2. The process as claimed in claim 1, wherein the surfactant comprises an oligoglycoside of the formula:

$$R^1O—(G)_p \quad (I)$$

in which $R^1$ is at least one member selected from the group consisting of alkyl group containing 4 to 22 carbon atoms and alkenyl group containing 4 to 22 carbon atoms, G is a sugar unit containing 5 or 6 carbon atoms and p is a number from 1 to 10.

3. The process as claimed in claim 1 wherein the surfactant comprises fatty acid N-alkyl polyhydroxyalkylamide of the formula:

$$R^2CO—\overset{\overset{R^3}{|}}{N}—(Z) \quad (II)$$

wherein $R^2CO$ is an aliphatic acyl group containing 6 to 22 carbon atoms, $R^3$ is a member selected from the group consisting of hydrogen, an alkyl group containing 1 to 4 carbon atoms and a hydroxyalkyl group containing 1 to 4 carbon atoms and (Z) is a linear or branched polyhydroxyalkyl group containing 3 to 12 carbon atoms and 3 to 10 hydroxyl groups.

4. The process as claimed in claim 1 wherein the inorganic member comprises a zeolite of the formula:

$$M^1{}_{2/z}O.Al_2O_3.xSiO_2.yH_2O \quad (IV)$$

in which $M^1$ is an alkali metal or alkaline earth metal, z is the valence of $M^1$, x is a number from 1.8 to 12 and y is a number from 0 to 8.

5. The process as claimed in claim 1 wherein the inorganic member comprises at least one water glass of the formulas:

$$(SiO_2)_m(M^2{}_2O)_{n1} \text{ and} \quad (V)$$

$$(SiO_2)_m(M^2{}_2O)_{n2}(H_2O)_{x2} \quad (VI)$$

wherein $M^2$ is at least one member selected from the group consisting of lithium, sodium and potassium; m and n1 are whole numbers or decimal fractions >0; n2=1; and x2=0 or an integer from 1 to 20.

6. The process as claimed in claim 1 wherein the granulation is carried out in contact with at least one member selected from the group consisting of anionic surfactants and nonionic surfactants.

7. The process of claim 2 wherein the surfactant comprises fatty acid N-alkyl polyhydroxyalkylamide of the formula:

$$R^2CO—\overset{\overset{R^3}{|}}{N}—(Z) \quad (II)$$

wherein $R^2CO$ is an aliphatic acyl group containing 6 to 22 carbon atoms, $R^3$ is a member selected from the group consisting of hydrogen, an alkyl group containing 1 to 4 carbon atoms and a hydroxyalkyl group containing 1 to 4 carbon atoms and (Z) is a linear or branched polyhydroxyalkyl group containing 3 to 12 carbon atoms and 3 to 10 hydroxyl groups.

8. The process of claim 2 wherein the inorganic member comprises a zeolite of the formula:

$$M^1{}_{2/2}O.Al_2O_3.xSiO_2.yH_2O \quad (IV)$$

in which $M^1$ is an alkali metal or alkaline earth metal, z is the valence of $M^1$, x is a number from 1.8 to 12 and y is a number from 0 to 8.

9. The process of claim 2 wherein the inorganic member comprises at least one water glass of the formulas:

$$(SiO_2)_m(M^2{}_2O)_{n1} \text{ and} \quad (V)$$

$$(SiO_2)_m(M^2{}_2O)_{n2}(H_2O)_{x2} \quad (VI)$$

wherein $M^2$ is at least one member selected from the group consisting of lithium, sodium and potassium; m and n1 are whole numbers or decimal fractions >0; n2=1; and x2=0 or an integer from 1 to 20.

10. The process of claim 2 wherein the granulation is carried out in contact with at least one member selected from the group consisting of anionic surfactants and nonionic surfactants.

11. The process of claim 3 wherein the inorganic member comprises a zeolite of the formula:

$$M^1{}_{2/z}O.Al_2O_3.xSiO_2.yH_2O \quad (IV)$$

in which $M^1$ is an alkali metal or alkaline earth metal, z is the valence of $M^1$, x is a number from 1.8 to 12 and y is a number from 0 to 8.

12. The process of claim 3 wherein the inorganic member comprises at least one water glass of the formulas:

$$(SiO_2)_m(M^2{}_2O)_{n1} \text{ and} \quad (V)$$

$$(SiO_2)_m(M^2{}_2O)_{n2}(H_2O)_{x2} \quad (VI)$$

wherein $M^2$ is at least one member selected from the group consisting of lithium, sodium and potassium; m and n1 are whole numbers or decimal fractions >0; n2=1; and x2=0 or an integer from 1 to 20.

13. The process of claim 3 wherein the granulation is carried out in contact with at least one member selected from the group consisting of anionic surfactants and nonionic surfactants.

14. The process of claim 4 wherein the granulation is carried out in contact with at least one member selected from the group consisting of anionic surfactants and nonionic surfactants.

15. The process of claim 5 wherein the granulation is carried out in contact with at least one member selected from the group consisting of anionic surfactants and nonionic surfactants.

16. The process of claim 1 wherein the drying and granulating is carried out by using fluidizing air which enters the fluidized bed at a temperature of from 50° C. to 400° C.

17. The process of claim 1 wherein the surfactant granules have a residual moisture content of up to 20% by weight.

18. The free-flowing, non-lump forming readily soluble product of the process of claim 1.

19. The process of claim 1 wherein the air fluidizing medium flows through the fluidized bed at a velocity of from 1 to 8 meters/second.

20. The process of claim 19 wherein the air fluidizing medium enters the fluidized bed at a temperature of from 90° C. to 350° C.

* * * * *